United States Patent [19]

Zorzy

[11] Patent Number: 4,925,403

[45] Date of Patent: May 15, 1990

[54] COAXIAL TRANSMISSION MEDIUM CONNECTOR

[75] Inventor: John Zorzy, Swampscott, Mass.

[73] Assignee: Gilbert Engineering Company, Inc., Glendale, Ariz.

[21] Appl. No.: 255,458

[22] Filed: Oct. 11, 1988

[51] Int. Cl.[5] ..... H01R 17/18; H01R 19/00

[52] U.S. Cl. ..... 439/578; 439/851

[58] Field of Search ..... 439/851, 852, 856, 578, 439/579, 580, 581, 582, 583, 584, 585

[56] References Cited

U.S. PATENT DOCUMENTS 3,860,323 1/1975 Fisches et al. ..... 439/851

4,426,127 1/1984 Kubota ..... 339/177

OTHER PUBLICATIONS

Sealectro Cororation—SSIS Specifications—p. 10.

*Primary Examiner*—Z. R. Bilinsky

*Attorney, Agent, or Firm*—Don J. Flickinger; Jordan M. Meschkow; Lowell W. Gresham

[57] ABSTRACT

There is disclosed, in a coaxial transmission medium connector, a female center conductor element having a tubular male-center-conductor-element-receiving region extending from an open end to a blind end and which is characterized by an inner surface which diverges from a first position proximate the open end to a second position rearwardly toward the blind end in conjunction with a wall thickness which tapers from a maximum value proximate the first position to a less thick region at a second position toward the blind end. With this configuration, electrical contact between a male center conductor element and the female center conductor element of a slightly axially misaligned mating pair will be very nearly diametrically opposed and hence limit signal degradation at the junction. Typically, the coaxial transmission medium connector is still further characterized by the provision of at least one pair of diametrically opposed longitudinal slots extending from the open end toward the second end to provide a spring bias to aid in grasping the male member within the female member.

16 Claims, 3 Drawing Sheets

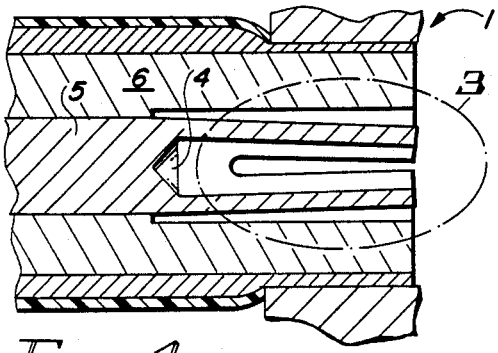
FIG. 1
(PRIOR ART)
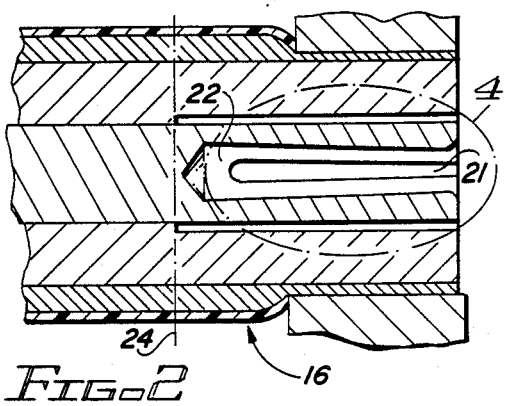
FIG. 2
FIG. 3
(PRIOR ART)
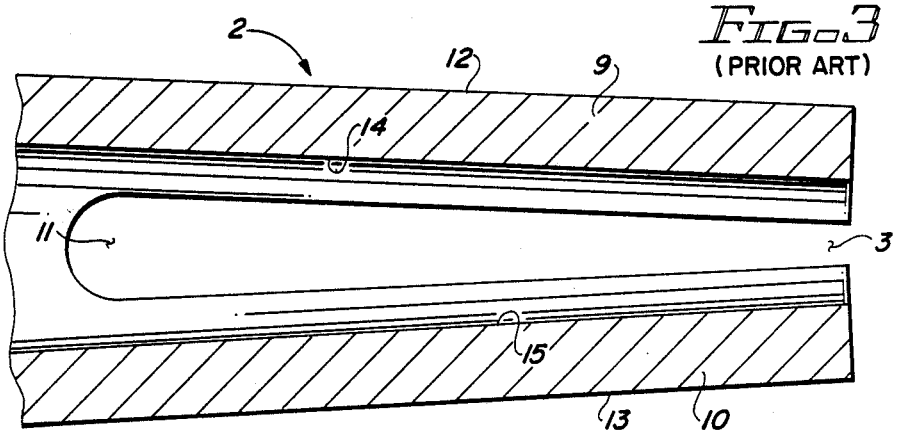
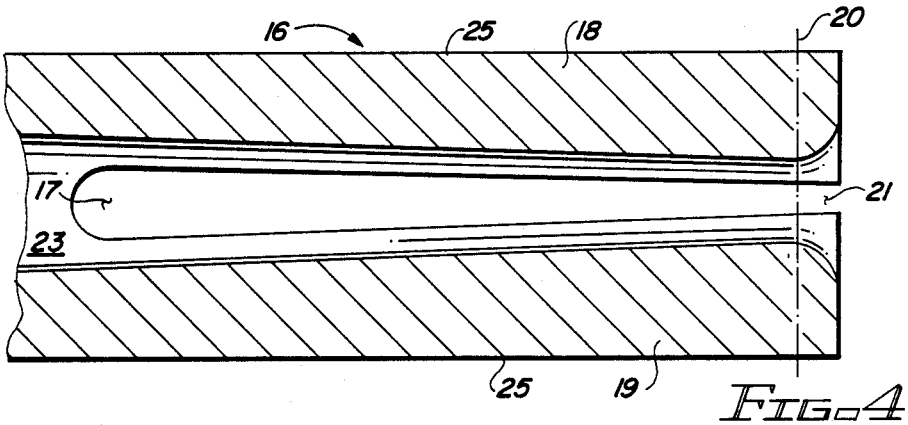
FIG. 4
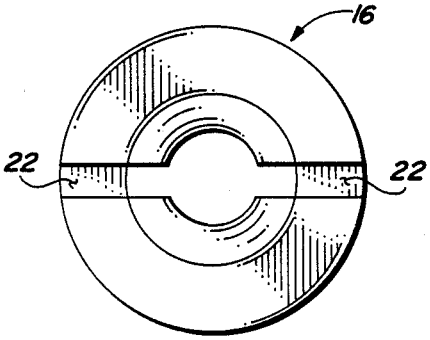
FIG. 9
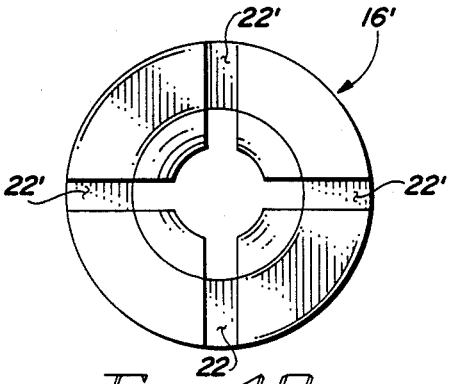
FIG. 10

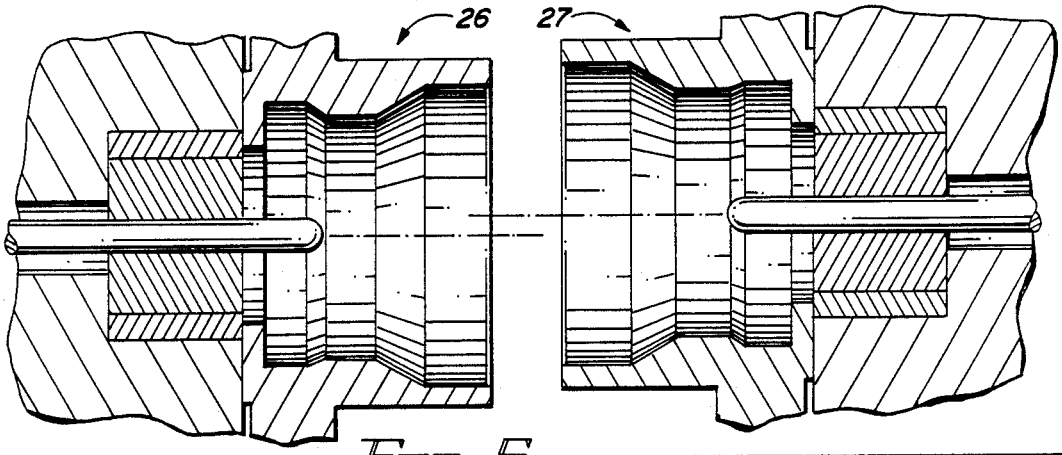
FIG. 5
FIG. 6
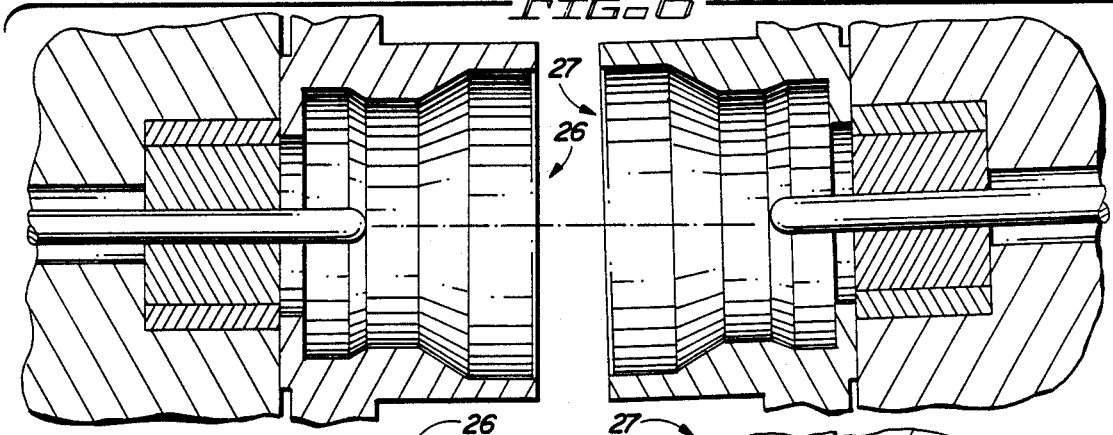
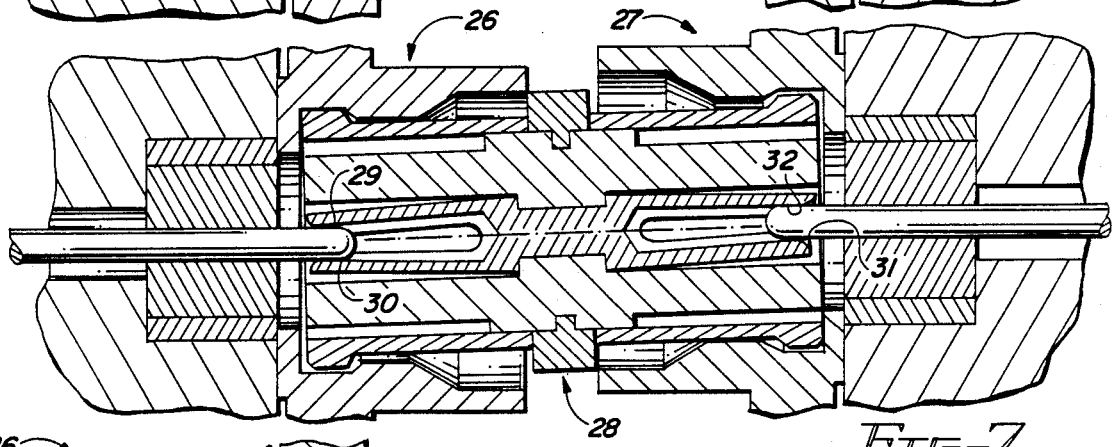
FIG. 7
(PRIOR ART)
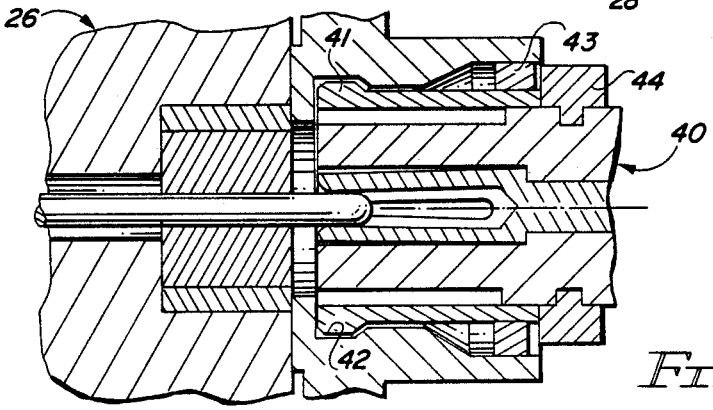
FIG. 11

COAXIAL TRANSMISSION MEDIUM CONNECTOR

FIELD OF THE INVENTION

This invention relates to the electrical connector arts and, more particularly, to connectors for coupling together coaxial transmission modules, ports, cables, and like coaxial transmission mediums, especially when operated at microwave frequencies.

BACKGROUND OF THE INVENTION

Coaxial transmission mediums for conveying information at microwave frequencies are often particularly characterized by their relatively small size which is not only a consequence of the operation frequency range, but is also particularly attributable to the applications and environments of the systems in which they are employed. For example, such systems may be found in sophisticated aircraft in which the size and weight of microwave electronics systems must be established as small and light to the extent reasonably possible.

In one specialized configuration for coupling together two such mediums (such as by coupling adjacent modules), the inner conductor mating element of each medium is configured as a male, and a double-ended female component (sometimes termed a "bullet") receives both male elements to complete the center conductor connection at the junction. Each female center conductor element of the bullet is typically provided with at least a pair of diametrically opposed longitudinal slots to effect a spring bias (particularly when opposing sides of the element are normally slightly sprung toward one another) for grasping the male center conductor elements of the adjoining modules.

An insidious problem which has been found to be associated with connections effected by such a connector system, when employed at microwave frequencies, is an erratic increase in the standing wave ratio (SWR) and insertion loss which can account for a significant signal loss/degradation. It has been found that a prominent source of such signal degradation is due to slight axial misalignment of the facing coupled male center conductor elements which cause the bullet, and each of its female center conductor elements, to be substantially skewed from longitudinal alignment with either of the male center conductor elements. Those skilled in the art will understand that the axial misalignment between the facing male center conductor elements may be either such that their respective axes may be parallel or nonparallel to one another. As a result of this axial misalignment, the two contact points between each of the male and female center conductor element pairs have been shown to be substantially longitudinally misplaced from diametric opposition, the latter being the ideal orientation for minimizing reflection and attenuation (or loss) at the joint. Further investigation has shown that this problem, associated with the skewing of the bullet from longitudinal alignment with the longitudinal axes of the facing male center conductor elements of modules or the like is a consequence of employing the standard configuration for the female center conductor element walls and is inevitable so long as the standard, more or less cylindrical, interior surface is utilized.

It is to minimizing reflection and attenuation from connector joints between mating coaxial transmission mediums that this invention is directed.

OBJECTS OF THE INVENTION

It is therefore a broad object of this invention to provide an improved connector joint assembly for connecting mating coaxial transmission mediums.

It is another object of this invention to provide such an improved connector assembly in which the introduction of reflections and radiation leakage is minimized.

It is a more specific object of this invention to provide such a connector assembly of the type in which the facing connector units each are configured with male center conductor elements which are bridged by a double ended female element or bullet.

It is a still more specific object of this invention to provide such a connector assembly in which the effects upon the transmission system standing wave ratio resulting from the skew of a bullet from the longitudinal axes of the male center conductor elements of adjoining modules is minimized.

In another aspect, it is a still more specific object of this invention to provide such a connector assembly in which the effects upon the transmission system standing wave ratio resulting from the skew of a coaxial cable connector male center conductor element from the longitudinal axis of the female center conductor element of a module or the like to which it is adjoined is minimized.

SUMMARY OF THE INVENTION

Briefly, these and other objects of the invention are achieved by providing, in a coaxial transmission medium connector, a female center conductor element having a tubular male-center-conductor-element-receiving region extending from an open end to a blind end and which is characterized by an inner surface which diverges from a first position proximate the open end to a second position toward the blind end in conjunction with a wall thickness which tapers from a maximum value proximate the first position to a less thick region at a second position toward the blind end. With this configuration, electrical contact between male and female center conductor elements of a slightly axially misaligned mating pair will be very nearly diametrically opposed and hence limit the introduction of reflection and/or insertion loss at the junction. In one embodiment, the female center conductor element is further characterized by a generally cylindrical outer surface in the region between the first and second positions when no male center conductor element is resident. Alternatively, the walls of the female center conductor element may be sprung inwardly to increase the rate of divergence of its inner surface. Typically, the coaxial transmission medium connector is still further characterized by the provision of at least one pair (and typically two pairs) of diametrically opposed longitudinal slots extending from the open end toward the second end to provide a spring bias to aid in grasping the male member within the female member.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a cross sectional view of a typical coaxial transmission medium junction according to the prior art and which has a female center conductor element adapted to receive a male center conductor mating element;

FIG. 2 is a similar view illustrating the corresponding structure of a coaxial transmission medium junction according to the present invention;

FIG. 3 is a greatly enlarged cross sectional view of the region identified at 3 in FIG. 1;

FIG. 4 is a similar greatly enlarged view of the region identified at 4 in FIG. 2;

FIG. 5 illustrates in cross section pairs of facing male center conductor elements in slightly misaligned mutual disposition with their axes parallel to one another, representing a first skew condition;

FIG. 6 is a view similar to FIG. 5 and illustrates pairs of facing male center conductor elements in slightly misaligned mutual disposition with their axes nonparallel to one another, representing a second skew condition;

FIG. 7 is a view in cross section illustrating the effect of the skew when a conventional double-ended female bullet element is employed to electrically connect the female center conductor elements of FIG. 5;

FIG. 9 is an end view of one of the female center conductor elements shown in FIG. 8;

FIG. 10 is a view similar to FIG. 9 and illustrating a female center conductor element according to the present invention and employing a plurality of pairs of diametrically opposed longitudinal slots to effect spring bias; and FIG. 11 illustrates an alternative construction employing the present invention in which a coaxial cable having a female center conductor element is connected to a module in such a manner as to minimize to effects of skew between the longitudinal axes of the adjoining center conductor elements.

DETAILED DESCRIPTION OF THE INVENTION

Figure 8:
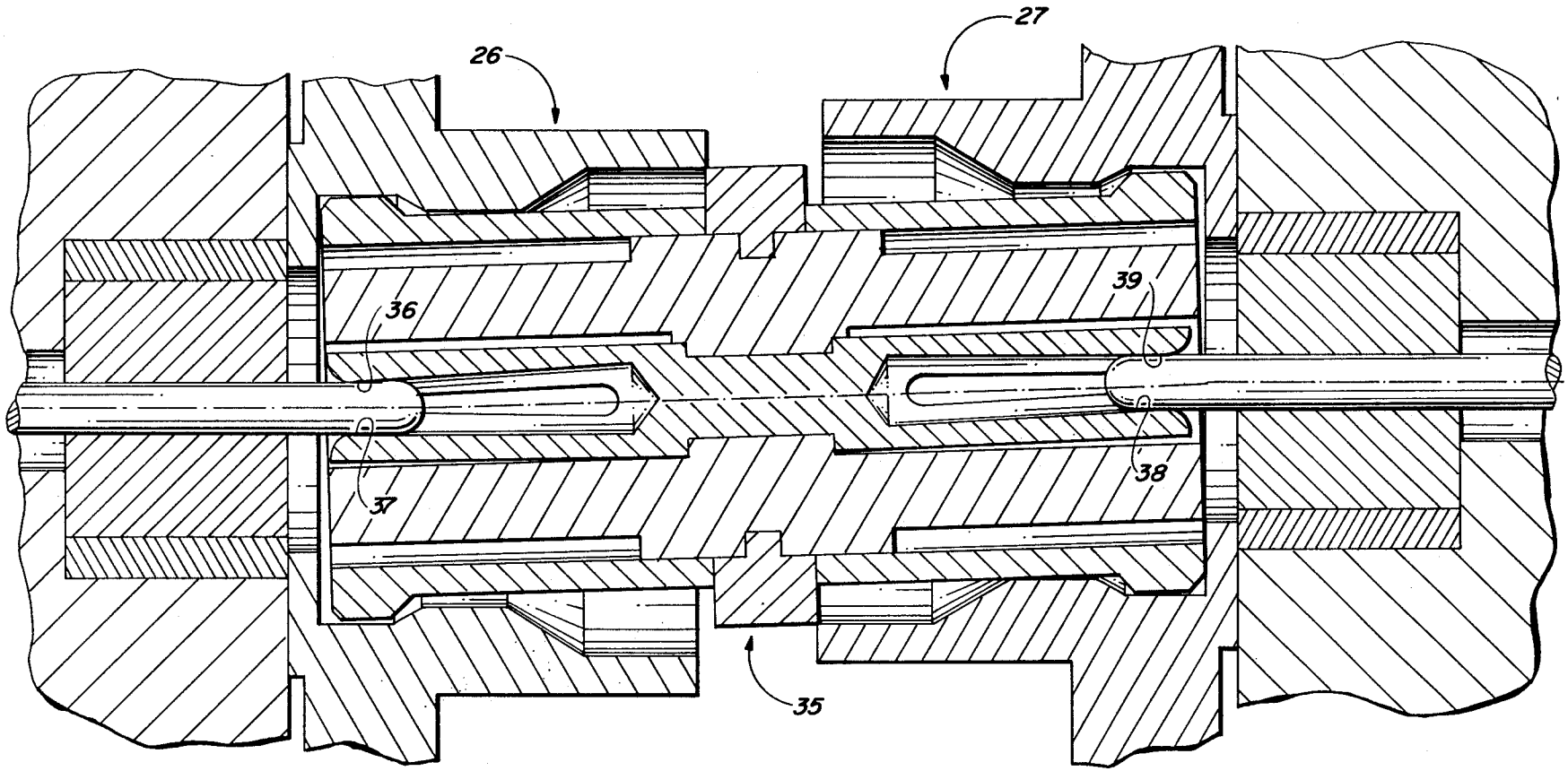
FIG. 8 is a view similar to FIG. 7 illustrating the corresponding effect when a double-ended female bullet incorporating the present invention is employed to connect the two facing female conductor elements of FIG. 5.

Referring now to FIG. 1, there is shown a generalized view of a coaxial medium transmission junction connector 1 which is broadly representative of the prior art structure typically provided at the female center conductor element 2 (which is connected to or merges with a center conductor 5). The female center conductor element 2 has a generally tubular male-center-conductor-element-receiving region extending from an open end 3 to a blind end 4. The center conductor 5 is encompassed by a dielectric 6 which, in turn, is encompassed by an outer conductor 7 which, in turn, may be overlaid with an outer insulator 8 if appropriate (as for a coaxial cable embodiment), all in the classical coaxial transmission medium configuration. The outer element of the connector 1 is conductive and in contact with the outer conductor 7 as shown to communicate the potential of the outer conductor to the outer conductor of a mating coaxially configured transmission element (not shown). No attempt has been made to show any detailed structure of the connector 1 (which may take many different forms) inasmuch as the invention is more specifically directed to an improvement in the configuration of the female center conductor element and its resulting change of relationship with a mating male center conductor element.

Attention is briefly directed to FIG. 3 which is a greatly enlarged version of the prior art female center conductor element of FIG. 1. It will be observed that opposing wall regions 9, 10 are sprung inwardly as permitted by the provision of a longitudinal slot 11 (and the corresponding diametrically opposed slot not shown in FIG. 3 because of the cross sectional nature of the illustration). The thickness of the wall regions 9 and 10 are uniform along their lengths such that the outer surfaces 12, 13 are each generally parallel to the inner surfaces 14, 15 of the individual wall regions. Thus, all the surfaces 12, 13, 14 15 converge toward the open end 3 of the female element 2. Those skilled in the art will appreciate that two pairs of longitudinal slots 11, circumferentially spaced at 90°, are often provided with the resulting four wall sections all being sprung inwardly more or less as shown in FIG. 3. As will be discussed further below, the purpose of springing the wall sections inwardly is to provide a spring bias for positively engaging a male center conductor element which may be introduced into the female conductor element 2.

Consider now the very different cross sectional configuration of the subject female center conductor element 16 illustrated in FIG. 2 in the region 4 (all other aspects of the coaxial cable connector illustrated in FIG. 2 corresponding to those shown in FIG. 1) and which is shown greatly enlarged in FIG. 4. Again, a single longitudinal slot 17 is illustrated, it being understood that a diametrically opposed longitudinal slot has been removed from the cross sectional view and that another pair of longitudinal slots, rotated 90° from the slot 17, may be optionally provided.

In FIG. 4, it will be observed that several aspects of the subject female center conductor element differ from the typical prior art configuration. It will be particularly noted that the wall thickness of each of the upper and lower wall regions 18, 19 tapers from a maximum at a first position 20 proximate the open end 21 and diminishes substantially uniformly along the length of the female element toward the blind end 22 (FIG. 2) of the generally tubular male conductor receiving region 23 to a minimum thickness at a second position 24 proximate the blind end 22 (FIG. 2). Optionally, the female element 16 may have its wall regions left in an unstressed state as shown in FIGS. 2 and 4 or sprung inwardly (in a direction perpendicular to the plane of the longitudinal slot 17 an its diametrically opposite counterpart which has been removed in the Figs.) in a manner equivalent to that shown for the prior art construction of FIGS. 1 and 3. In the case of the former, the edges of the longitudinal slot 17, in the unstressed condition shown in FIG. 4, have generally parallel edges, and the outer surface 25 of the female center conductor element 17 is substantially cylindrical along its entire length. Consequently, the inner surface of the female center conductor element diverges from the first position 20 to the second position 24. If the wall regions are sprung inwardly, the rate of divergence is accordingly increased.

The fundamental features discussed above of the subject inner conductor configuration serve to obtain very beneficial results when two slightly misaligned facing male center conductor elements to be are electrically connected by a double ended bullet member inserted into them both.

To illustrate the beneficial results, consider first the effect of slight axial misalignment upon a pair of male center conductor elements according to the prior art which are to be electrically connected by, for example, a double-ended male bullet component. Different exemplary misalignment conditions are represented in FIGS. 5 and 6. In FIG. 5, the axial misalignment between the male components 26, 27 can be clearly seen (the axes of the actual center conductor male elements being more or less parallel, but offset), and it may be noted that a misalignment of these proportions is not unusual because of the small size of the connectors, manufacturing tolerances, crimping tolerances, etc., all as is well known in the art.

In FIG. 6, a different sort of misalignment is shown, the axial misalignment between the male elements of the facing components 26, 27 being such that projections of their axes cross. Those skilled in the art will appreciate that, as a practical matter, axial misalignment in an actual given environment may be a combination of the conditions shown in FIGS. 5 and 6 and similar other misalignment conditions. The effects to be discussed below are essentially the same for the various misalignment conditions possible such that the condition of FIG. 5 will be taken as exemplary.

Thus, referring now to FIG. 7, a prior art double-ended female bullet 28 has received both the male elements of the components 26, 27 to electrically connect them. The components 26,26 might be, for example, ports of adjacent modules fixed in position on a substrate such as a printed circuit board; again, all as well known in the art. It will be immediately seen that the bullet 28 is substantially skewed from longitudinal alignment with the axis of the male center conductor element of either the component 26 or the component 27. As a result, electrical contact between the bullet 28 and the male element of the component 26 takes place at points 29 and 30. Similarly, electrical contact between the male element of the component 27 and the bullet 28 takes place at points 31 and 32. It will immediately be seen that these contact points at each male/female element junction are widely displaced longitudinally and, as previously discussed, this longitudinal displacement results in significant degradation of the signal transferred across the junctions, particularly when microwave frequencies are being employed.

In contrast, consider now the effect of a similar misaligned condition when female center conductor elements according to the present invention are employed. As shown in FIG. 8, components 26, 27 having male center conductor elements are disposed in substantially face to face juxtaposition and are misaligned axially to approximately the same degree as shown in FIGS. 5 and 7. A double-ended female bullet 35 effects electrical connection between the male components 26, 27; however, because of the configuration of each female element in the region occupied by the by the male center conductor elements of the components 26, 27, the contact points at the male/female junctions are brought very much more nearly into the ideal diametrically opposed positions. More particularly, the contact points between the double-ended female bullet 35 and the male element of the component 26 are found to be at points 36 and 37. Similarly, the contact points between the male element of the component 27 and the bullet 35 are found to be at points 38 and 39. As a result, with substantially the same amount of misalignment between the facing female elements, the signal degradation experienced at the junctions depicted in FIG. 8 using the female center conductor element configuration of the subject invention is very much reduced from that experienced from the junction illustrated in FIG. 7 using female center conductor elements configured according to the prior art.

While, as also shown in the end-on view of FIG. 9, a pair of opposed longitudinal slots in diametric opposition may be provided to obtain a single pair of opposing wall elements in the subject female center conductor element, those skilled in the art will appreciate that more pairs of opposing slots may be provided to appropriately limit the insertion force for the bullet or like component to be coupled and to more readily accommodate misalignment of facing center conductor elements in various radial directions. Thus, as shown in FIG. 10, the female center conductor element 16, may have a first pair of opposing longitudinal slots 22 and a second pair of opposing longitudinal slots 22″ placed circumferentially 90° from the slots 22′.

Attention is now directed to FIG. 11 which illustrates that the subject invention is not limited to coupling fixedly juxtaposed components, but rather as also applicable to diverse applications such as coupling a coaxial cable to a stationary module. More particularly, a stationary component 26 having a male center conductor element may be coupled to such components as a coaxial cable connector 36 in such a manner that slight axial misalignment between the adjoining male/female elements may be accommodated without undue signal degradation. It is desirable, however, to obtain a reasonable limitation on the range of misalignment which might be experienced, and this result is achieved through two additional features. First, if the flange region 41 is provided (it may not be necessary in all applications), it is made a closer fit to the recess 42 than is the case with adjoining juxtaposed components which may be best understood by referring to the corresponding regions in FIGS. 7 and 8. Second, a split conductive snap ring 43 is provided circumferentially disposed about the component 40 within the component 26 adjacent its adjoining end. The snap ring 43 serves to limit the axial misalignment between the male/female couping elements to an extent which may be readily accommodated by the specific configuration of the female element as previously described. Close inspection of FIG. 11 will reveal that a small degree of such misalignment remains, but is of no electrical consequence because of the effect of the configuration of the female elements. A retaining ring 44 may be provided encompassing the component 40 just beyond the end of the component 26 to insure retention of the snap ring 43. It has also been found that the snap ring 43 further reduces residual leakage and electromagnetic interference which may be present at the junction.

It is useful to note that the subject invention has wide application in the relevant art in that it is not limited to connecting two fixedly juxtaposed modules or a module to a coaxial cable, but rather can be employed in any combination, utilizing the basic connection scheme described, of mating configurations which may include snap in, slide in, threaded, bayonet, etc., as well as connectors attached to a module, integral with a module or employed with an impedance terminator.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. In a coaxial transmission medium connector, a female center conductor element having:

(a) a socket for receiving a male center conductor element, said socket including
  (i) an open end;
  (ii) a blind end; and
  (ii) a tapered inner surface which diverges from a first position proximate said open end to a second position proximate said blind end; and (b) a resilient wall region surrounding said socket, said wall region having a thickness which decreases from a maximum proximate said first position to a minimum proximate said second position.

2. The coaxial transmission medium connector of claim 1, wherein said wall region comprises an outer surface which is generally cylindrical between said first position and said second position.

3. The coaxial transmission medium connector of claim 1, further comprising a first pair of diametrically opposed longitudinal slots formed in said wall region, said slots extending from said open end toward said blind end.

4. The coaxial transmission medium connector of claim 2, further comprising a first pair of diametrically opposed longitudinal slots formed in said wall region, said slots extending from said open end toward said blind end.

5. The coaxial transmission medium connector of claim 3, further comprising a second pair of diametrically opposed longitudinal slots formed in said wall region, said slots extending from said open end toward said blind end.

6. The coaxial transmission medium connector of claim 4, further comprising a second pair of diametrically opposed longitudinal slots formed in said wall region, said slots extending from said open end toward said blind end.

7. The coaxial medium connector of claim 1, wherein said inner surface diverges from said first position to said open end, forming an enlarged entry region for guiding a male center conductor element into said socket.

8. The coaxial transmission medium connector of claim 7, wherein said inner surface proximate said enlarged entry region is rounded.

9. A coaxial transmission medium connector assembly comprising:

(a) a first coaxial transmission medium connector having a male center conductor element formed at one end;

(b) a second coaxial transmission medium connector having a male center conductor element formed at one end; and (c) a female center conductor component having first and second opposite ends, said first end comprising a first socket for receiving the male center conductor element of said first coaxial transmission medium connector, and said second end comprising a second socket for receiving the male center conductor element of said second coaxial transmission medium connector, wherein
  (i) each of said sockets includes
    an open end;
    a blind end; and
    a tapered inner surface which diverges from a first position proximate said open end to a second position proximate said blind end; and
  (ii) each of said sockets is surrounded by a resilient wall region, said wall region having a thickness which decreases from a maximum proximate said first position to a minimum proximate said second position.

10. The coaxial transmission medium connection assembly of claim 9, wherein said wall region surrounding each of said sockets comprises an outer surface which is generally cylindrical between said first position and said second position.

11. The coaxial transmission medium assembly of claim 9, further comprising a first pair of diametrically opposed longitudinal slots formed in said wall region surrounding each of said sockets, said slots extending from said open end toward said blind end.

12. The coaxial transmission medium assembly of claim 10, further comprising a first pair of diametrically opposed longitudinal slots formed in said wall region surrounding each of said sockets, said slots extending from said open end toward said blind end.

13. The coaxial transmission medium connector of claim 11, further comprising a second pair of diametrically opposed longitudinal slots formed in said wall region, said slots extending from said open end toward said blind end.

14. The coaxial transmission medium connector of claim 12, further comprising a second pair of diametrically opposed longitudinal slots formed in said wall region, said slots extending from said open end toward said blind end.

15. The coaxial transmission medium connector of claim 9, wherein said inner surface of each of said sockets diverges from said first position to said open end, forming an enlarge entry region for guiding one of said male center conductor elements into said socket.

16. The coaxial transmission medium connector of claim 15, wherein said inner surface proximate said enlarged entry region is rounded.

* * * * *